US006709353B1

(12) United States Patent
Peterson

(10) Patent No.: US 6,709,353 B1
(45) Date of Patent: Mar. 23, 2004

(54) RACQUET SPORT GAME AND SHUTTLECOCK FOR USE THEREWITH

(76) Inventor: Scott T. Peterson, 10435 Los Alamitos Blvd., Los Alamitos, CA (US) 90720

( * ) Notice: Subject to any disclaimer, the term of this patent is extended or adjusted under 35 U.S.C. 154(b) by 0 days.

(21) Appl. No.: 10/161,531

(22) Filed: Jun. 3, 2002

Related U.S. Application Data

(60) Provisional application No. 60/363,897, filed on Mar. 12, 2002.

(51) Int. Cl.[7] ..... A63B 67/18
(52) U.S. Cl. ..... 473/579; 473/580
(58) Field of Search ..... 473/579, 580

(56) References Cited

U.S. PATENT DOCUMENTS 1,393,407 A * 10/1921 Tenney
2,734,746 A * 2/1956 Sametz et al.
4,305,589 A * 12/1981 Popplewell
5,421,587 A * 6/1995 Mao-Huang
6,315,687 B1 * 11/2001 Todd et al. ..... 473/579

* cited by examiner

*Primary Examiner*—John A. Ricci
(74) *Attorney, Agent, or Firm*—James G. O'Neill.; Klein, O'Neill & singh, LLP

(57) ABSTRACT

A shuttlecock to be struck by a racquet has a shaped base and a number of separate flexible tail portions secured to the base. The base also has a piston element therein, so as to form a shuttlecock that has a varying movement or erratic flight performance when struck. A game is played by hitting the shuttlecock through a marked-off area called a flyzone. Scoring of a game or sets is determined by the elapsed time the shuttlecock is hit back and forth by at least two players through field goals formed at opposite ends of the marked-off area.

20 Claims, 7 Drawing Sheets

RACQUET SPORT GAME AND SHUTTLECOCK FOR USE THEREWITH

This application claims the benefit of pending provisional application No. 60/363,897, filed on Mar. 12, 2002.

BACKGROUND OF THE INVENTION

1. Field of the Invention

This invention relates generally to games and, more particularly, to an improved sports game and shuttlecock for use with the game.

2. Description of the Prior Art

Numerous types of games using balls or shuttlecocks hit by a racquet are known. If a shuttlecock is used, it is usually made with a cork or rubber nosecone and a tail of feathers or plastic. The known games are played by a number of persons who hit a ball or shuttlecock over a net on a lawn, in a backyard, on a court or other similar areas. In such known games, however, the playing area is usually arranged around a net and the item being struck normally has a predetermined course because of its size, shape and aerodynamic characteristics.

Applicant is unaware of any game that uses a "flyzone " where the players cannot enter, and which uses a shuttlecock having flexible fins and a piston incorporated therein.

Therefore, there remains the need in the art for a new game utilizing racquets to hit a shuttlecock through a "flyzone", and which provides the user with extended periods of enjoyment. Furthermore, the shuttlecock of the present invention holds up during play when hit with a racquet, and includes a base having a piston therein, as well as flexible, shaped tail portions to vary the flight of the shuttlecock during play, depending on how struck, the movement of the piston in the base, and the prevailing weather conditions.

SUMMARY OF THE INVENTION

Accordingly, It is a general object of the present invention to provide an improved and novel sports game using a novel shuttlecock. It is a particular object of the present invention to provide an improved sports game played in a defined "flyzone". It is a further particular object of the present invention to provide a new game playable with racquets and a special shuttlecock wherein the players must stay out of a marked-off playing area or "flyzone" on a surface. It is still a more particular object of the present invention to provide an improved shuttlecock having an aerodynamically shaped, flexible tail thereon. It is yet a more particular object of the present invention to provide an improved shuttlecock having a base formed therewith, which base includes a piston member to aid in control of movement of the shuttlecock, after the shuttlecock is struck by a racquet. It is still a further particular object of the present invention to provide an improved shuttlecock having a base and tail thereon, which tail is formed from a plurality of identically shaped elements to enable the shuttlecock to be used with different racquets and in different weather conditions to provide better control of the shuttlecock. And, it is a further particular object of the present invention to play a game in which players utilizing racquets hit an improved shuttlecock back and forth through a defined "flyzone " marked-off on a surface, until a winner is determined by the player or players having the highest score during a single game or a set of games.

The game of the present invention is played by marking-off or staking-out a "flyzone" area utilizing telescoping corner poles. The marked-off or staked-out area is preferably rectangular, approximately forty (40) feet by twenty (20) feet to form two (2) end boundaries or field goals through which the shuttlecock must be hit.

In accordance with one aspect of the present invention, there is provided a shuttlecock having a base secured to a tail. The base is preferably hollow and includes means to hold a piston therein. The tail is comprised of a plurality of specifically shaped flexible elements secured to the base so as to form a shuttlecock having unique movements when struck by a racquet.

The object of the game of the present invention is to hit the shuttlecock through end boundaries or field goals formed by the corner poles without entering the "flyzone" formed by the poles and for the opposite player or players to return the shuttlecock through at least the field goal from which the shuttlecock was hit. The challenge is how many times the players can hit the shuttlecock back and forth without making a mistake. To aid in playing the game, only underhand or slow serving is permitted, so as to allow the shuttlecock to get into play.

The game starts by a serve, when any one of the players serves the shuttlecock through the field goals to another player behind the opposite field goal. After the serve and during play, 2 or more players hit the shuttlecock back and forth through the opposed field goals during a rally. The amount of time the shuttlecock is hit back and forth during the rally is timed, and if one of the players does not return the shuttlecock to the other, the other player is awarded a number of points, dependent on the time the shuttlecock has been hit back and forth during the rally. Play continues until a player reaches a predetermined number of points to win the game. The players then play a predetermined number of games, and the winning player will be determined by the winner of the majority of games in a match or a set, or when a predetermined number of points is reached. For example, the first player to win three games wins the match or set, or the first player to reach say one thousand points wins. The players alternate serving each game.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1A:
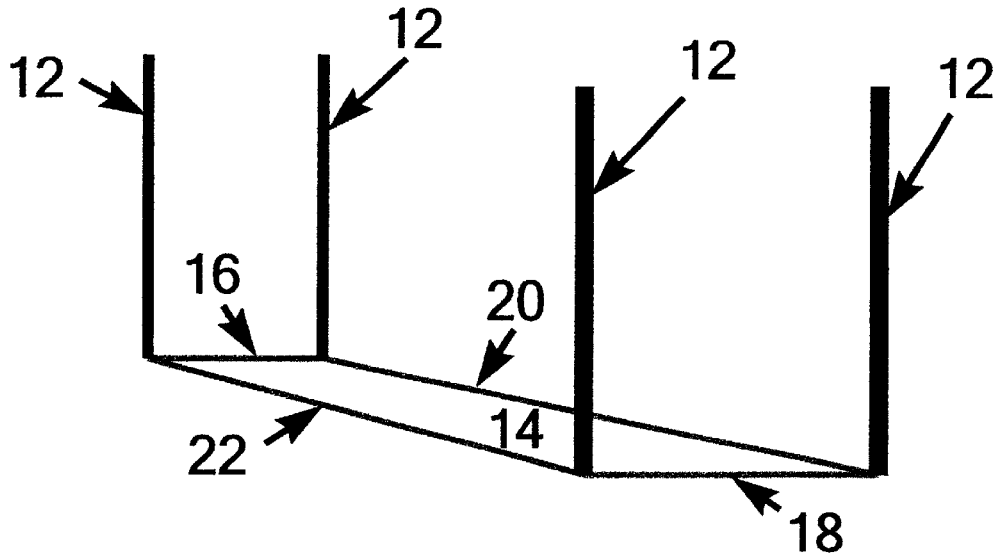
FIG. 1A is a perspective view of the playing field of FIG. 1.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved game and method of playing and an improved shuttlecock for use therewith. The present invention may be played on any surface. However, it is described as played on the preferred surfaces of turf, sand or grass.

There are but four (4) components or pieces of equipment that are needed to play the game of the present invention. These components comprise: 1. at least two (2) racquets, 2. at least one (1) shuttlecock 10, 3. at least four (4) corner markers, poles or pylons 12, and 4. a Torque Timer watch to score the game. Tubular sleeves or anchor tubes may also be used with the corner pylons 12.

Figure 1:
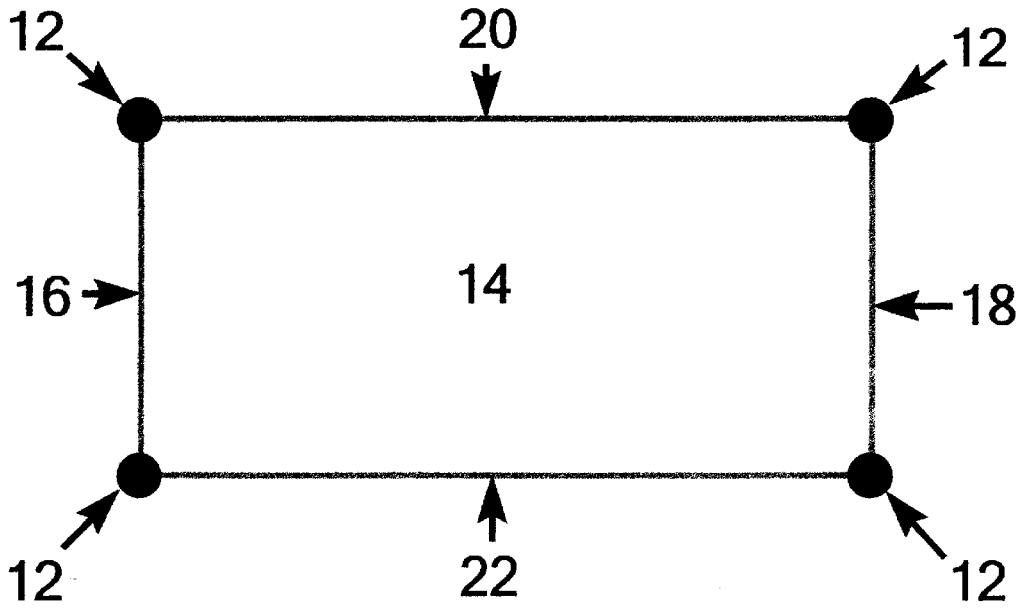
FIG. 1 is a schematic view showing a playing field of the game of the present invention.
Figure 2:
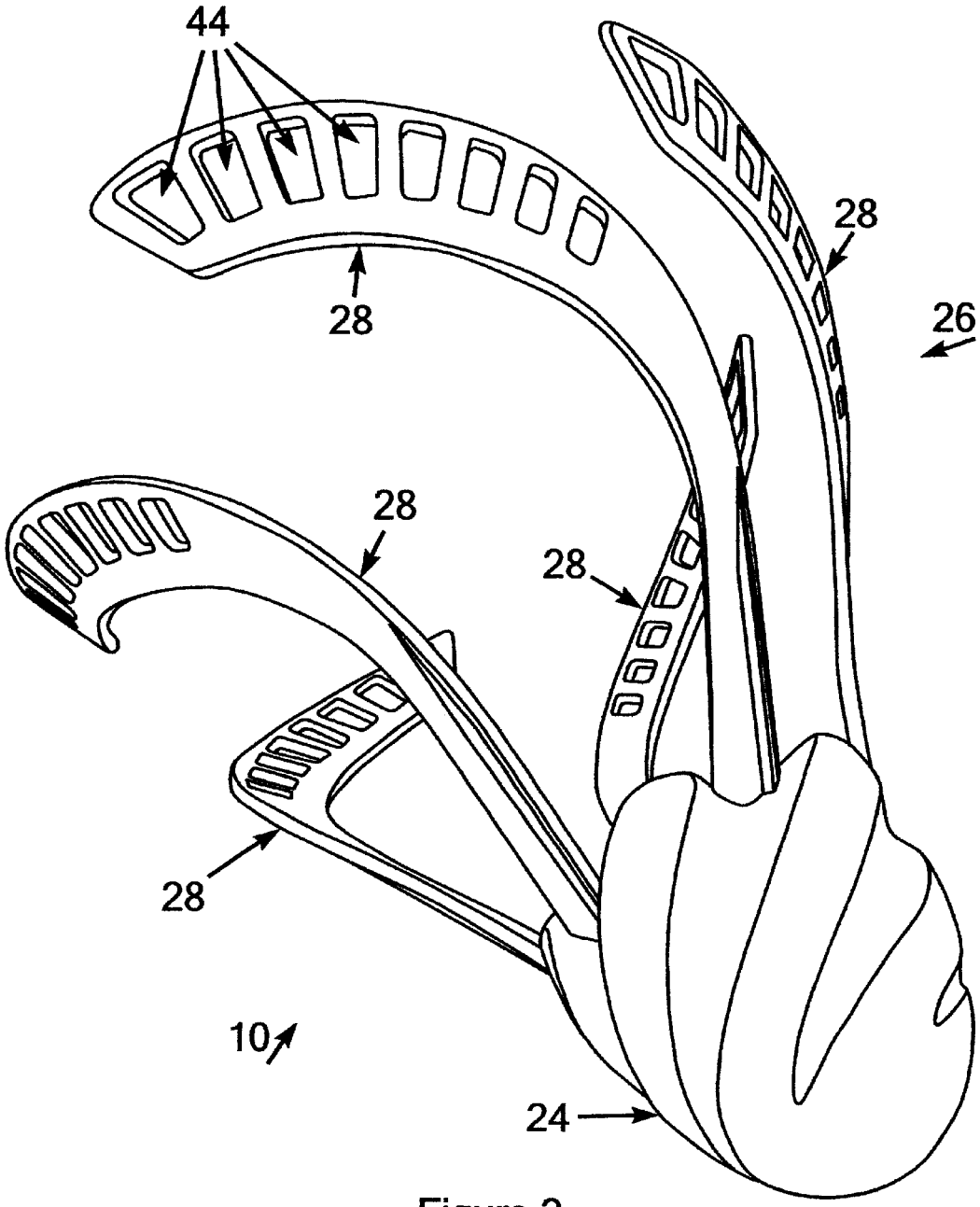
FIG. 2 is a perspective view of a preferred embodiment of an improved shuttlecock of the present invention.
Figure 3:
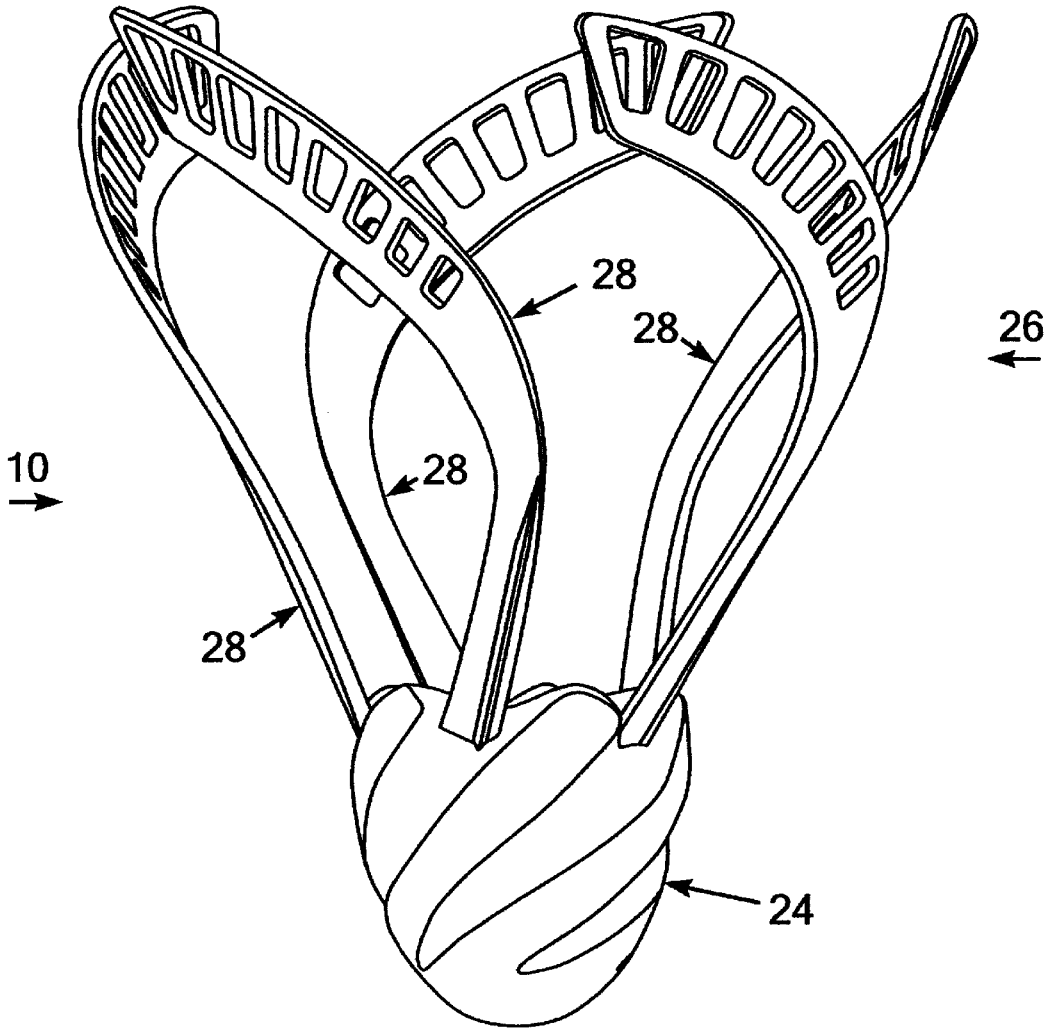
FIG. 3 is a front elevational view of the shuttlecock of FIG. 2.
Figure 4:
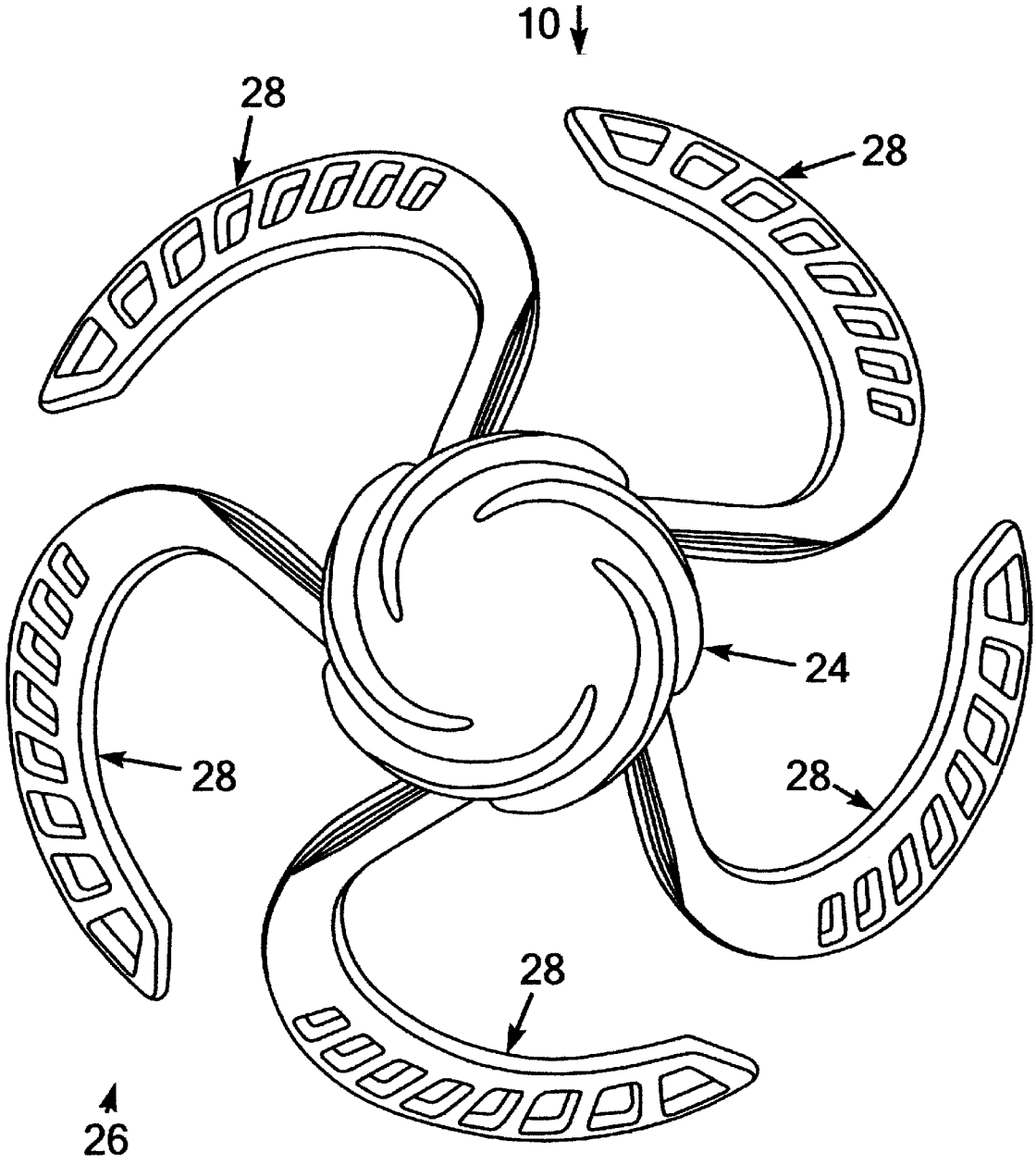
FIG. 4 is a bottom plan view of the shuttlecock of FIG. 2.
Figure 5:
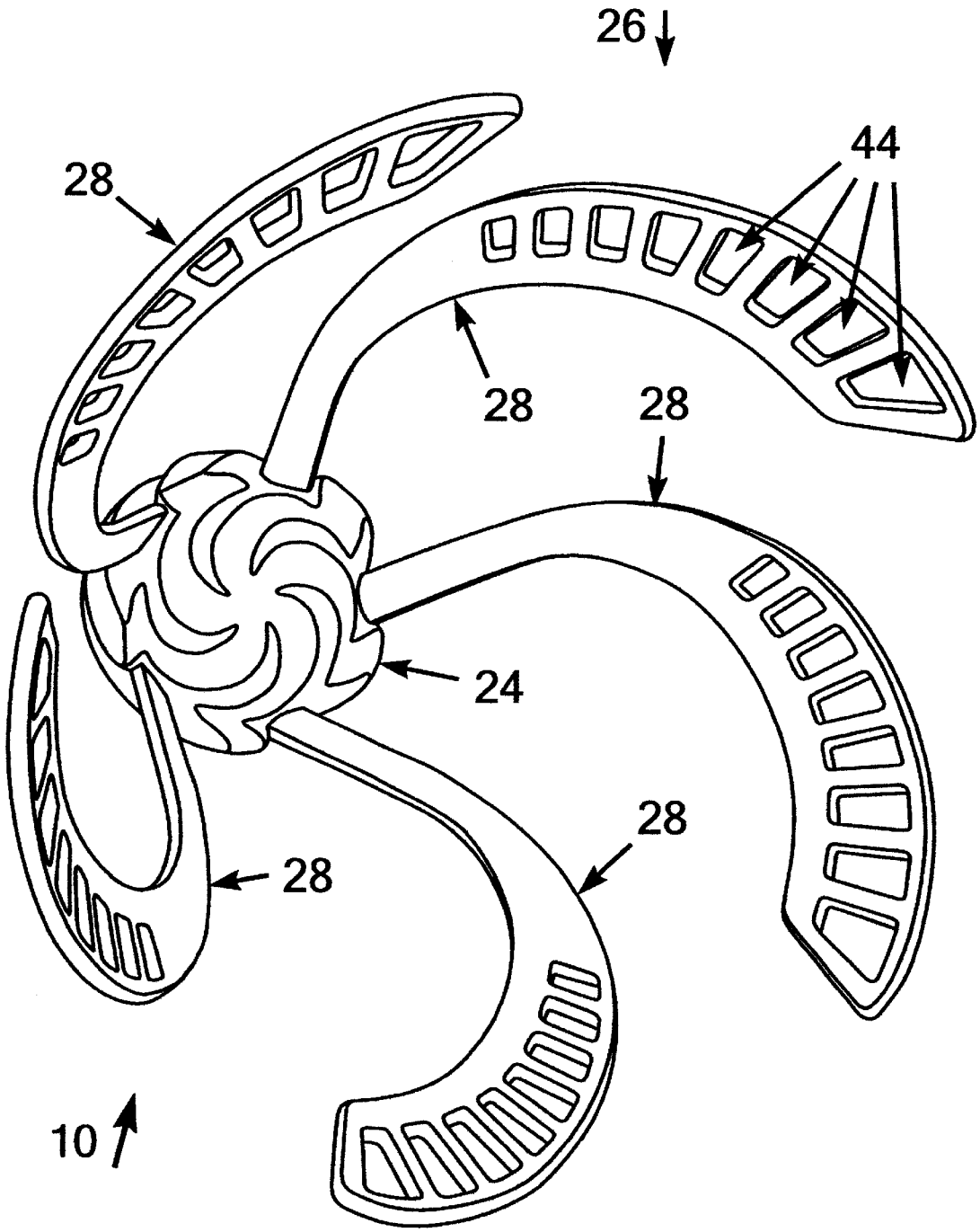
FIG. 5 is a further perspective view of the improved shuttlecock of the present invention, looking from the top.
Figure 6:
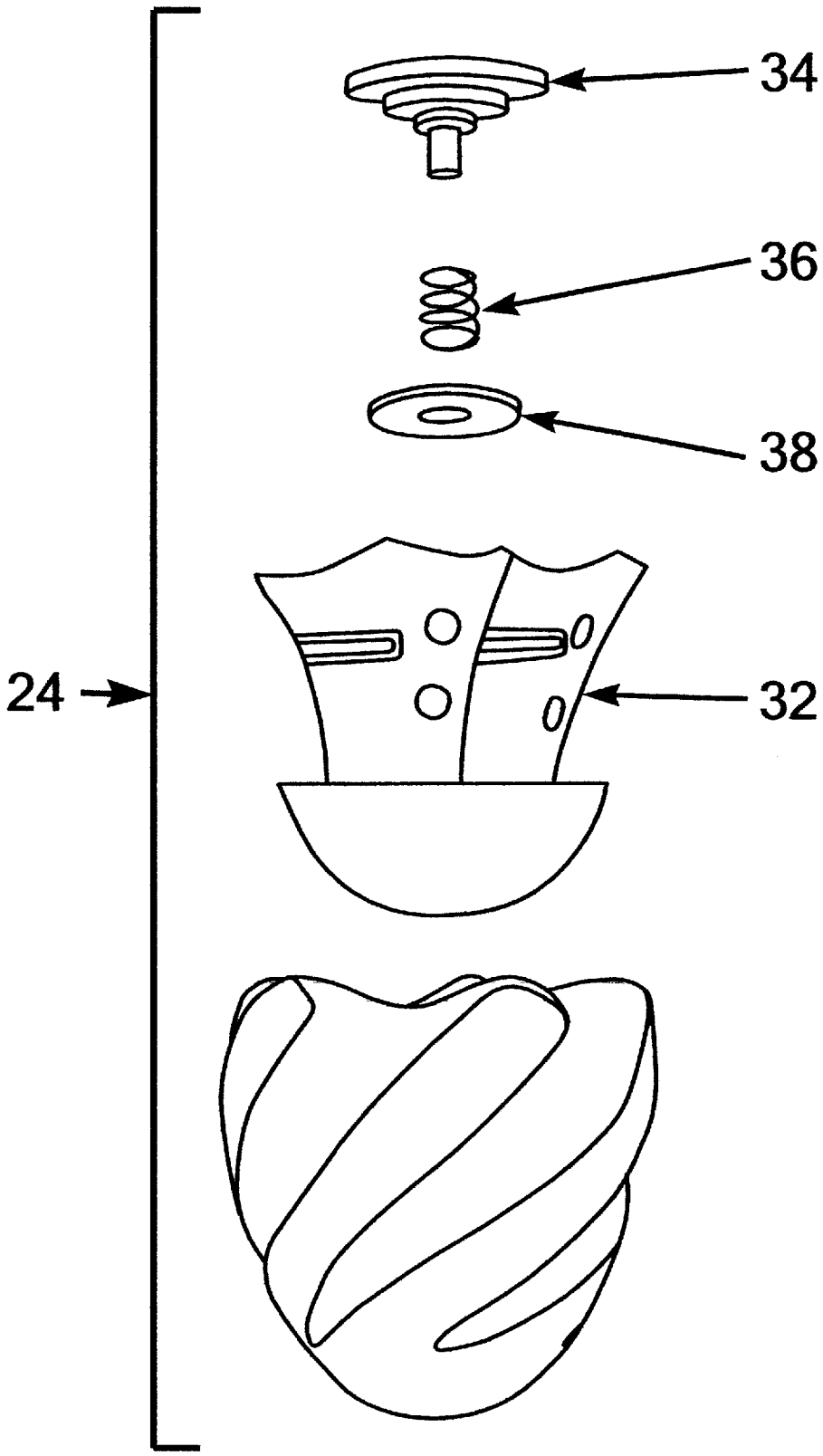
FIG. 6 is a partial exploded view of the elements of the improved shuttlecock of the present invention.

As shown in FIGS. 1 and 2, using the pylons 12, a playing field 14, approximately 40 feet by 20 feet is formed by inserting the 4 corner markers or posts 12 at each corner of a rectangle on a relatively flat area. The playing field 14 is generally referred to as the "flyzone". The corner markers or posts 12 are preferably telescoping, and may be held by anchor tubes or sleeves inserted into grass, soft dirt, sand or turf at the four corners of the rectangular flyzone 14.

The object of the game is for a first person to hit the shuttlecock 10 with a racquet from one end or side of the flyzone 14 through an end boundary or field goal 16 formed by the two poles 12, through an opposite end boundary or field goal 18, and for a second person outside the opposite field goal 18 to return the shuttlecock through the field goal 16. Each player tries to hit the shuttlecock 10 in a rally or volley back through the other field goal without making a mistake, such as missing the shuttlecock or missing the other field goal.

RULES OF PLAY AND HOW TO KEEP SCORE

The game may be played by two or more players in two different ways by the game or by the set. If by the game, the first player to reach a century, for example, the number of seconds of elapsed time the shuttlecock has been hit back and forth.

If played by the set, the first player to reach a millennium, for example, 1000 points and/or win three games, wins the set. During the set, the players alternate serving after each game.

To determine who serves, the players may use any method to select how to serve, such as a volley for serve. Either of the players hits the shuttlecock to the other and after the shuttlecock has been hit back and forth a minimum number of times, say three times in a row, the first player to make a mistake, for example, hits the shuttlecock short of or to the side of the opposite field goal, allows the other or opposite player to serve.

The shuttlecock must be served underhand and over service marks on the flyzone poles. The idea is to get the shuttlecock into play and to have rallies or volleys that last many seconds.

During play, points are scored by timing the amount of time, in seconds, by means of the Torque Timer. That is, scoring is with the Torque Timer watch, which is preferably a wristwatch that has several unique features. There is a rally timer stopwatch used to time each rally which becomes a score with one second equaling one point. There are 3 player tally windows with corresponding buttons on the timepiece that are used to add the scores as each player accumulates points.

Once the rally timer has been stopped (at the end of the rally), the numeric value is then tacked or given to player who has won the rally by pressing the button that corresponds to its window. This timepiece will keep adding the appropriate points to the player that wins each rally.

The Torque Timer will also include a watch that will have the time and an overall elapsed time for the game. Once a new game has started, a match timer window will be activated.

For example, the point count (say 15 seconds, etc.) from a rally is given to the player that last hits the shuttlecock through the front 16 and rear 18 boundary or field goals of the flyzone 14 without the opposite player returning the shuttlecock.

If either player makes a shot from a side, such as 20 or 22, through the opposite boundary or field goal, without the shuttlecock 10 passing through the closest boundary or field goal, after an initial serve, the shot will count. If either player steps into the flyzone 14 or hits a corner pole 12 with their racquet, they default and points are awarded to the other player. Furthermore, during play, players cannot hit the shuttlecock more than once in a row when serving or returning the shuttlecock. If either player hits the ball more than once, the other player is awarded the points (at least one) accumulated during a rally or volley.

Play continues until a player or team wins a game or game set(s), as explained above.

After play is finished, the corner poles or pylons and any anchor tubes are preferably removed from the playing surface and the elements of the game packed and stored for future use.

The shuttlecock 10 of the present invention may be of any desired size, with the elements made from any desired material. For example, a fluted base or nosecone 24 may be made from a resilient plastic or hardened rubber, and a tail 26, having a plurality of identical or similar elements or portions 28 made from a resilient plastic, or other similar flexible material. Additionally, fastening elements 30 securing the tail portions 28 to the base 24 may be made from metal or plastic.

Figure 7:
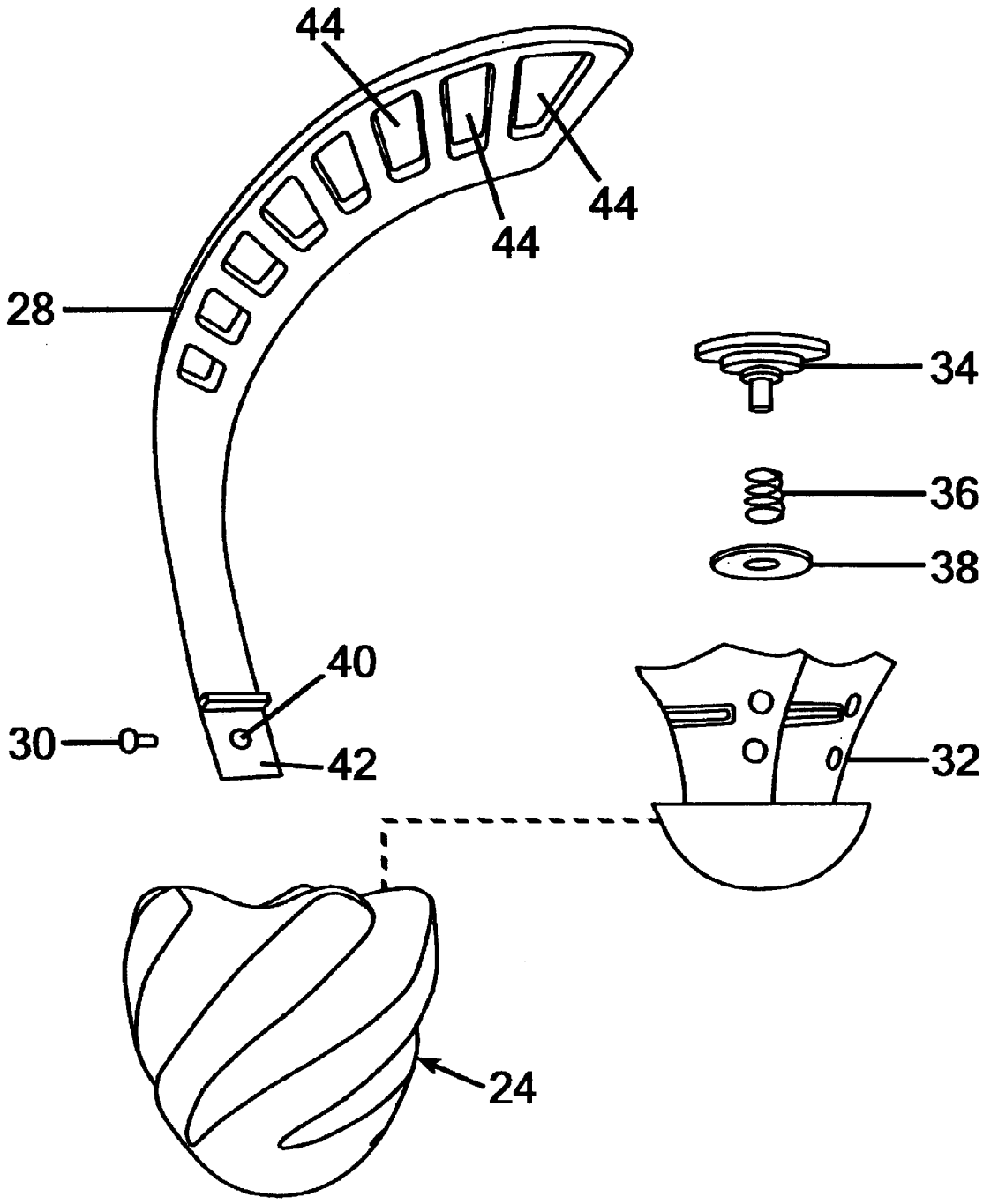
FIG. 7 is a further partial exploded view of the elements of the improved shuttlecock of the present invention.

The base 24 and tail 26 are preferably assembled, formed or manufactured, as described below. The base 24 includes a fluted exterior and an internal shell or core housing 32 supporting a piston 34, a biasing spring 36 and a washer 38 in a central chamber or opening formed in the core housing. The central chamber or opening may include centering ribs (not shown) for the piston, spring and washer. The elements or portions of tail 26 are secured to the base 12 by any desired means, such as a plurality of pins 30, inserted through openings 40 formed on lower portions 42 of each tail portion 28 (see FIG. 7 ). The tail portions 28 are preferably very flexible with straight inner portions and curved outer ends or portions, and spaced around the inner surface of nose 24 or the outer surface of core housing 32. After being secured to or in the nose 24, the flexible elements 28 are free to flex during flight after being hit by a racquet. Each of the elements 28 includes a plurality of openings 44 formed on the outer portion thereof.

The core housing 32 is inserted and held in the opening in base 24 to form the completed shuttlecock 10, shown in FIGS. 2–5. Each of the tail portions 28 includes at least two and preferably more openings or apertures 44 formed at the outer ends thereof. These apertures are sized and dimensioned so as to provide control of the shuttlecock 10 during flight after it is hit by a racquet, or the like. Each tail portion 28 is cut, formed or stamped to provide its shape and size, as well as the plurality of apertures 44.

The core housing 32 holds the piston 34 therein, against the spring 38. The piston 34 is held in the core housing 32 in any desired manner, such as by a retaining means, to allow movement thereof, against the bias of the spring, when struck by a racquet.

As shown in the drawings, the assembled base 24 and tail 26 are ideally sized and shaped to control the flight of the shuttlecock when struck by a racquet.

The apertures 44 in the tail portions 28 may vary in size and may include dividing segments therebetween or therein. By varying the size of the apertures and the dividing or separating segments, the movement of the shuttlecock in different weather conditions (calm, light winds, heavier winds) is varied. Or, if desired, different size bases 24 and tail portions 28 may be utilized depending on the skill of the players when hitting the shuttlecock back and forth through the flyzone 14.

It, therefore, can be seen that the present invention provides an improved and novel game and shuttlecock for use therewith, which allows two or more players to hit the shuttlecock, which has uncontrolled flight characteristics, with a racquet through a marked-off area or space, and scoring the game, as described. The tail portions may be changed if a base made from a different material or size is used, or if different weather conditions prevail.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A shuttlecock for a racquet sport game, comprising;

a base having a nosecone and a hollow housing with a movable piston held therein; and a tail comprised of a plurality of flexible elements releasably secured to the base;

each of the plurality of flexible elements being spaced from adjoining flexible elements and having at least two apertures formed in outer ends thereof, away from the base.

2. The shuttlecock of claim 1 wherein the nosecone has a fluted outer surface.

3. The shuttlecock of claim 2 wherein the piston includes a spring and a washer held in the hollow housing.

4. The shuttlecock of claim 3 wherein the plurality of flexible elements are secured to the base by fastening elements passing through openings formed in lower portions of the plurality of flexible elements.

5. The shuttlecock of claim 4 wherein the plurality of flexible elements include straight inner portions and curved outer portions, and the curved outer portions have the at least two apertures therein.

6. The shuttlecock of claim 5 wherein the fastening elements are pins passing through the openings and into base.

7. The shuttlecock of claim 1 wherein the plurality of flexible elements are secured to the base by the pins.

8. The shuttlecock of claim 7 wherein the plurality of flexible elements include straight inner portions having openings formed therein, adjacent the base and curved outer portions having the at least two apertures formed therein; and wherein the pins are inserted through the openings and into the base.

9. The shuttlecock of claim 8, further including a spring and a washer held in the hollow housing and cooperating with the piston.

10. The shuttlecock of claim 9 wherein the nosecone has a fluted outer surface and the hollow housing is a separate cone housing held in the nosecone, and the plurality of flexible elements are secured around an upper edge of the cone housing.

11. A variable flight shuttlecock for a racquet sport game, comprising:

a base having a nosecone with a fluted exterior and a hollow interior;

a cone housing held in the hollow interior;

the cone housing having a spring biased piston held therein; and a tail comprised of a plurality of separate flexible elements secured in the base;

each of the plurality of separate flexible elements having a first, substantially straight portion secured in the base, and a second, curved portion having a plurality of apertures formed therein, whereby, when the shuttlecock is struck it will take a variable flight path.

12. The variable flight shuttlecock of claim 11, further including a washer held in the cone housing and cooperating with the spring biased piston.

13. The shuttlecock of claim 12 wherein the first, substantially straight portion has an opening formed therein and a pin passes through the opening for securing the substantially straight portion in the base.

14. The shuttlecock of claim 13 wherein the plurality of separate flexible elements are secured around an upper edge of the cone housing.

15. A variable flight shuttlecock for a racquet sport game, comprising:

a hollow base having a movable piston held therein; and a tail comprised of a plurality of flexible tail portions releasably secured to the hollow base; each of the plurality of flexible tail portions being spaced from adjoining flexible tail portions and having at least two apertures formed in outer ends thereof, away from the hollow base.

16. The variable flight shuttlecock of claim 15 wherein the hollow base comprises a nosecone having a fluted outer surface and an internal separate hollow housing.

17. The variable flight shuttlecock of claim 15 wherein the movable piston includes a spring and a washer held in the hollow base.

18. The variable flight shuttlecock of claim 15 wherein the plurality of tail portions are secured in the hollow base by fastening elements passing through openings formed in lower portions of the plurality of tail portions.

19. The variable flight shuttlecock of claim 15 wherein the plurality of flexible tail portions include straight inner portions and curved outer portions, and the curved outer portions have at least two apertures formed therein.

20. The variable flight shuttlecock of claim 15 wherein the hollow base comprises a nosecone having a fluted outer surface and a hollow cone housing held in the nosecone, and the plurality of flexible tail portions are secured around an upper edge of the cone housing by means of a fastening elements.

* * * * *